US005237760A

United States Patent [19]

Altman et al.

[11] Patent Number: 5,237,760

[45] Date of Patent: Aug. 24, 1993

[54] ELECTRICALLY LIGHTED FOOTWEAR

[75] Inventors: Peter R. Altman, 13538 Maryearl La., Poway, Calif. 92067; Yuval Shenkal, San Diego, Calif.

[73] Assignee: Peter R. Altman, Austin, Tex.

[21] Appl. No.: 848,090

[22] Filed: Mar. 9, 1992

[51] Int. Cl.[5] ..... A43B 23/00

[52] U.S. Cl. ..... 36/137; 36/103

[58] Field of Search ..... 36/137, 1; 362/103, 362/108

[56] References Cited

U.S. PATENT DOCUMENTS

| | | | |
|---|---|---|---|
| 1,597,823 | 8/1926 | Randolf | 36/137 X |
| 1,933,243 | 10/1933 | Merolis et al. | 36/137 X |
| 2,405,384 | 8/1946 | White | 240/6.4 |
| 2,473,877 | 6/1949 | Goldstein | 36/137 X |
| 2,572,760 | 11/1951 | Rikelman | 36/1 |
| 2,632,093 | 3/1953 | De Merolis et al. | 240/6.4 |
| 2,931,893 | 4/1960 | Gonzalez et al. | 36/137 X |
| 2,941,315 | 6/1960 | Irving et al. | 36/1 |
| 3,008,038 | 11/1961 | Dickens et al. | 240/6.4 |
| 3,067,322 | 12/1962 | Sala | 240/6.4 |
| 3,070,907 | 1/1963 | Rocco | 36/137 X |
| 3,564,232 | 2/1971 | Ellerbe | 240/6.4 |
| 3,800,133 | 3/1974 | Duval | 240/6.4 W |
| 3,893,247 | 7/1975 | Dana, III | 36/137 |
| 3,946,505 | 3/1976 | Dana, III | 36/2.5 |
| 4,020,572 | 5/1977 | Chiaramonte, Jr. | 36/137 |
| 4,112,601 | 9/1978 | Chiaramonte, Jr. | 36/137 |
| 4,130,951 | 12/1978 | Powell | 36/137 |
| 4,158,922 | 6/1979 | Dana, III | 36/137 |
| 4,234,907 | 11/1980 | Daniel | 362/32 |
| 4,324,054 | 4/1982 | Rovinsky | 36/137 |
| 4,367,515 | 1/1983 | Beard | 362/103 |
| 4,412,205 | 10/1983 | Von Kemenezky | 340/331 |
| 4,438,482 | 3/1984 | Leon et al. | 362/103 |
| 4,463,412 | 7/1984 | Broach | 362/61 |
| 4,480,293 | 10/1984 | Wells | 362/108 |
| 4,521,832 | 6/1985 | Barbour | 362/103 |
| 4,570,206 | 2/1986 | Deutsch | 362/103 |
| 4,599,682 | 7/1986 | Stephens | 362/103 |
| 4,651,447 | 3/1987 | Sullivan | 36/137 |
| 4,712,319 | 12/1987 | Goria | 36/137 |
| 4,748,366 | 5/1988 | Taylor | 310/32.8 |
| 4,793,075 | 12/1988 | Thatcher | 36/11.5 |
| 4,848,009 | 7/1989 | Rodgers | 36/137 |
| 5,033,212 | 7/1991 | Evanyk | 36/137 |
| 5,052,131 | 10/1991 | Rondini | 36/11.5 X |

FOREIGN PATENT DOCUMENTS

| | | | |
|---|---|---|---|
| 2715100 | 10/1978 | Fed. Rep. of Germany | 36/137 |

*Primary Examiner*—Steven N. Meyers
*Assistant Examiner*—Ted Kavanaugh
*Attorney, Agent, or Firm*—Bernard L. Kleinke; Jerry R. Potts

[57] ABSTRACT

Footwear includes a light source housed in a forward tip recess of the sole, and a push-bottom switch is mounted in a recess within the back contour of the heel for activation manually by tapping the back of the heel against a stationary object. A battery compartment is formed in an enlarged portion of the recess. A curved, focused lens contoured to the outer configuration of the sole tip is releasably connected over the frontal opening of the battery compartment. A releasably connected bulb-mounting assembly is interposed between the lens and the battery compartment. The sole includes a thin bottom layer, a thick central layer having front and back cut-outs defining the recess and a top layer supporting a foot strap.

15 Claims, 6 Drawing Sheets

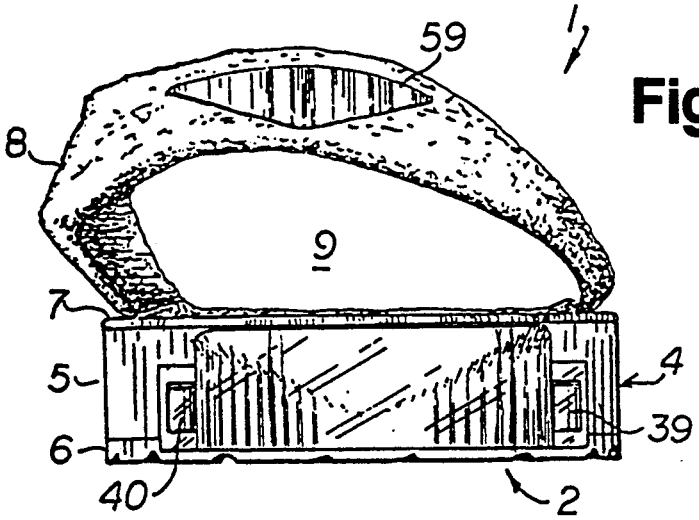
Fig. 3
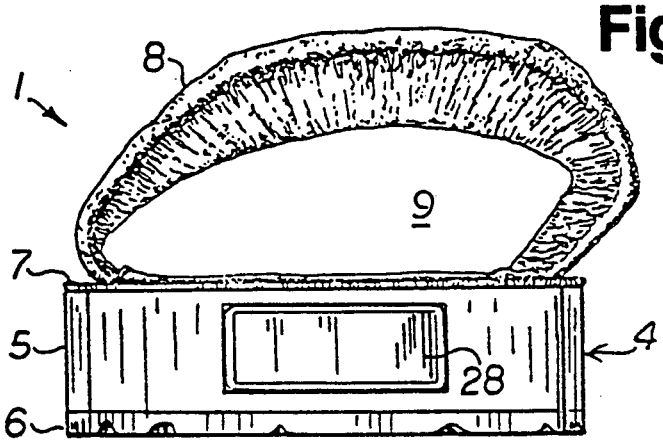
Fig. 4
Fig. 5
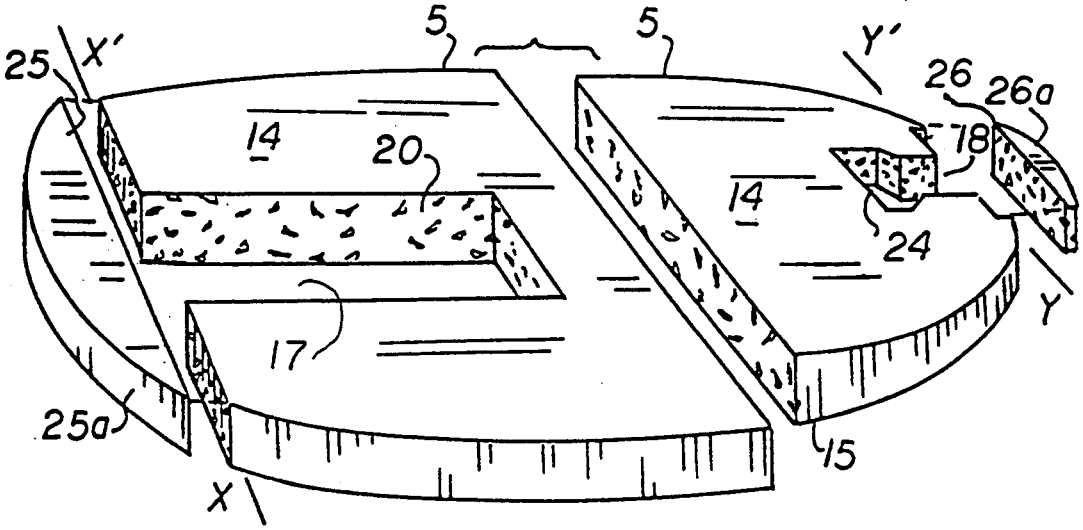

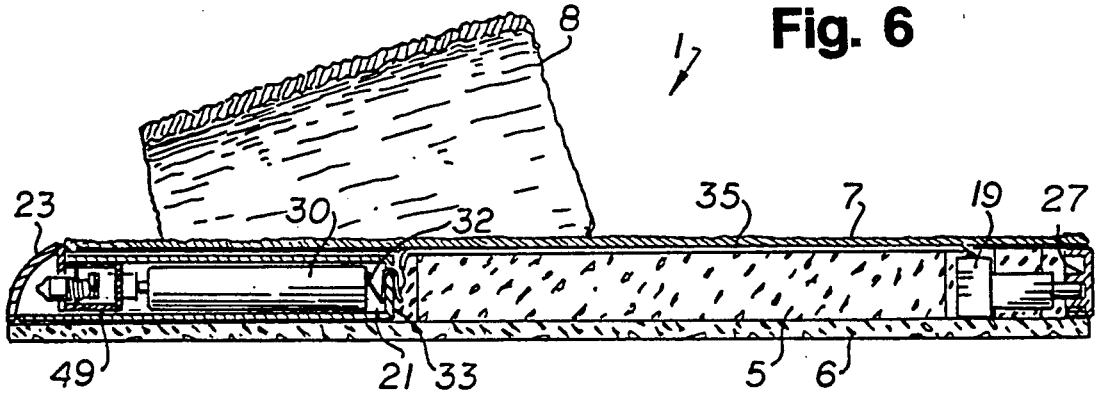
Fig. 6
Fig. 7
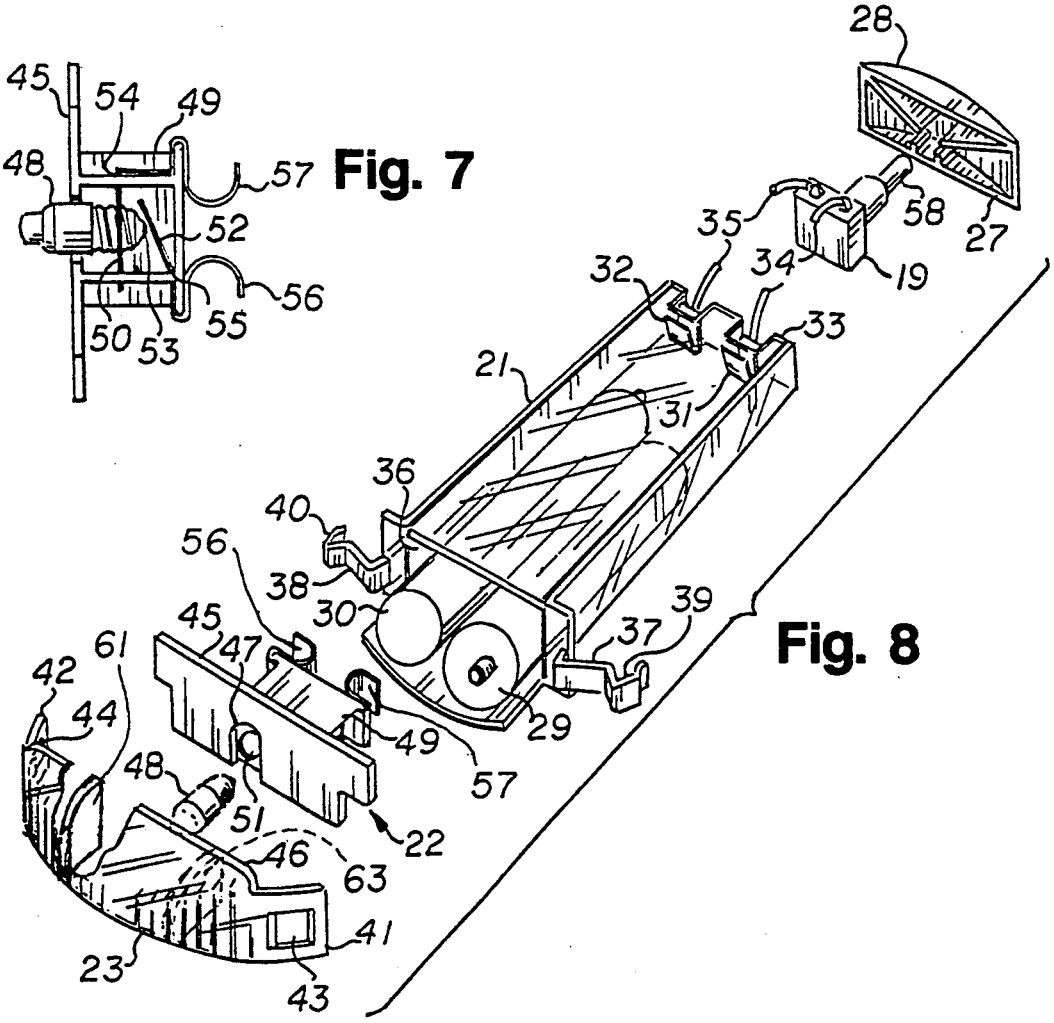
Fig. 8

ELECTRICALLY LIGHTED FOOTWEAR

DESCRIPTION

1. Technical Field

This invention relates to footwear, and more specifically to footwear with a built-in light source for use in the dark or other inadequately lighted areas.

2. Background Art

There are many situations where one is required to be active during low light conditions, such as in the middle of the night, early in the morning before the sun rises, or even throughout the day in indoor spaces with inadequate illumination for the task at hand. When the environment does not provide adequate illumination to perform the intended activity or activities, a person can, of course, compensate by the use of such illuminating devices as hand held flashlights or the like. Oftentimes, an activity to be carried out requires the use of both hands, or at least having one hand free to perform other tasks simultaneously with the execution of the main activity. The result of combining a two handed activity in an environment with insufficient lighting can be an inefficient, frustrating, and possibly an injury producing situation. For example, the carrying of packages into a darkened room, can be dangerous, because the person can accidentally slip and fall, or otherwise bump into objects in the room and cause unwanted and unintended breakage thereof.

In an attempt to overcome such situations, electrically lighted footwear has been proposed. By freeing one hand of the responsibility of carrying an instrument of illumination, such as a flashlight, a person need not interrupt the activity.

With the use of lighted footwear, both hands are free to perform desired tasks. There is no need to find a flashlight, since the footwear illuminated the darkened area for the wearer.

Previously, the idea of lighted footwear has been addressed primarily for decorative purposes. Originally, the lighted footwear included a battery switch and bulb fixture, which the user would mount on a shoe. However, such an arrangement was not aesthetically pleasing in appearance, and generally not very functional.

As an improvement, the battery, switch and bulb were incorporated into the footwear itself. Once incorporated into the shoe, many variations appeared. Some had lamps located within the heel, which was made of a transparent material, so that the entire heel would be illuminated. In this regard, reference may be made to U.S. Pat. No. 3,893,247.

Others had lamps in a platform sole which would flash on and off decoratively, so that the footwear could be used advantageously while dancing. See, for example, U.S. Pat. No. 4,158,922. Yet other electrically lighted footwear had lamps located on the exterior of the shoe to provide other ornamental features.

While such various different types and kinds of electrically lighted footwear were self-contained and reasonably attractive in appearance, some of them were switched on and off by the user while taking steps. Although the on/off switching arrangement, synchronized with the walking motion, may have been satisfactory for some applications, such an activation arrangement can be, for some, difficult to operate.

To overcome these drawbacks, switches were provided within the footwear with an actuator stem protruding beyond the outer periphery of the footwear. See, for example, U.S. Pat. No. 3,893,247. In this manner, the wearer could more readily and easily energize the bulb by manipulating the actuator stem on and off without having to take a step.

While such an arrangement may be satisfactory for some applications, it is not aesthetically pleasing in appearance to a wearer who may desire to use the footwear on a regular basis, as opposed to infrequent use, such as footwear used for dancing. Moreover, the complex construction requires a battery access through the insole, and the access closure may cause discomfort to the user. The protruding stem is not aesthetically pleasing in appearance, and is apparent to others that a switch is clearly visible on the shoe.

Thus, it would be highly desirable to have lighted footwear, which has access to the internal components from the outside of the footwear and which does not have components which are mounted visibly in a less than attractive manner.

All of the prior known electrically lighted footwear suffered from the same drawback, of an inadequate light source. In this regard, a small battery powered light source mounted on one or both of the shoes or slippers, does not provide sufficient illumination for certain conditions. For example, when walking down a dimly lit flight of stairs, the prior known shoe mounted light sources would only provide some light on the stair on which the person is standing, and not the lower stairs. Thus, the potentially dangerous condition could result.

Another example of a shortcoming of all of the prior known electrically lighted footwear, is the fact that the small light sources mounted on the shoes were totally inadequate for some outdoor situations. For example, when the prior known lighted footwear were worn outdoors at night, such low powered lights at ground level did not provide adequate lighting. Once again, unsafe conditions were not able to be adequately illuminated.

In short, all of the conventional lighted footwear had lower powered light sources which provided only a low level of illumination at ground level. Small, light weight batteries could only be used, due to size and weight requirements.

Thus, it would be desirable to have electrically lighted footwear, which could provide a high level of illumination, without the need for larger, bulky batteries. Also, such footwear should be aesthetically pleasing in appearance, without obvious appendages, such as switches and actuators for the light source.

In addition, such footwear should be functional and not merely decorative. It should provide a beam of light to illuminate the space adequately in front of the user. Such footwear should be relatively inexpensive to manufacture, and must be relatively easy to use.

Another problem with prior known electrically lighted footwear has been associated with adequately securing the low powered lamp and batteries to the footwear so the lamp and batteries do not become dislodged easily or fail to maintain sufficient electrical contact for completing an electrical circuit. For example, when a user walks, the lamps and batteries mounted to the footwear experience a repetitive series of abrupt impacts as the user moves along his or her path of travel. Such repetitive impacts can result in separation between the lamp and its associated batteries and thus, unwanted and undesired electrical failures can occur.

Therefore it would be highly desirable to have electrically lighted footwear that would maintain a positive electrical contact between a lamp and its associated batteries and that secures the batteries in a more positive manner within the housing. Also, such footwear should be highly functional so that the lamp can be removed from its associated housing without complete disassembly of the lamp housing from the battery housing.

DISCLOSURE OF INVENTION

Therefore, the principal object of the present invention is to provide a new and improved lighted footwear wherein the components of the light system are contained within the footwear without extending beyond the periphery of the footwear in an aesthetically pleasing manner.

Another object of the present invention is to provide such a new and improved lighted footwear, which is able to provide a sufficient beam of light in front thereof to provide a high level of illumination in front of the user.

Yet another object of the present invention is to provide such a new and improved lighted footwear which is relatively inexpensive to manufacture, and which is convenient to use.

A further object of the present invention is to provide such a new and improved lighted footwear wherein the lamp and battery component of the light system are maintained in positive electrical contact and yet can be separated easily and quickly for replacement purposes.

Briefly, the above and further objects of the present invention are realized by providing electrically lighted footwear, which has a lighting system completely disposed within the slipper with no protruding parts. The unit provides a high intensity, broad beam of light, and is relatively inexpensive to manufacture.

An electrically lighted footwear and method of using it, includes an electrical system completely contained within the sole of the footwear and confined within the contours of the sole. A switch, located in the rear portion of the sole and which conforms in shape with the contours of the adjacent sole, controls the operation of a battery/lamp unit located in the forward portion of the sole. The lamp of the battery/lamp unit is enclosed within a removably connected wide angle lens which forms a natural extension of the forward portion of the sole and providing a broad beam of light for improved illumination.

The lighted footwear, preferably in the form of a slipper, provides a bright wide angle beam of light for illumination, and is aesthetically pleasing in appearance. The improved slipper is comfortable to wear. The battery/lamp unit providing the light includes a battery housing having an open end for receiving a pair of batteries and two resilient prongs thereon, a lamp housing having a centrally disposed lamp mounting arrangement for receiving a lamp and a lamp lens cover for protecting the lamp having a pair of spaced apart receptacles.

In one embodiment of the invention, the batteries and battery housing are located within the sole, with the open end of the battery housing and its two associated prongs extending forwardly. The lamp housing is seated on the battery housing with the lamp directed forwardly by engaging the two resilient prongs of the battery housing with the lamp cover receptacles, thereby enclosing the batteries within the battery housing, and completing an electrical circuit between the batteries and the lamp.

In another embodiment of the invention, the battery/lamp unit includes a battery housing having an open battery compartment with a pair of spaced apart resilient prongs extending therefrom, a lamp housing having an open lamp mounting arrangement with a pair of rearwardly extending electrical contacts, a pair of spaced-apart resilient prongs mounted on the lamp housing with a pair of apertures disposed therebetween, and a lens cover having a pair of spaced apart receptacles.

The battery housing is located within the sole with the open end of the battery compartment and the prongs extending forwardly. The apertures within the lamp housing engage the two resilient prongs of the battery housing to secure removably the lamp housing to the battery housing, thereby causing batteries within the battery compartment to be enclosed therein and to make positive electrical contact with the contacts extending rearwardly from the lamp mounting arrangement. The lens cover is secured removably to the lamp housing by engaging the two resilient prongs of the lamp housing with a pair of lamp cover receptacles, thereby covering and protecting a lamp disposed within the lamp mounting arrangement.

Another important aspect of the inventive footwear, is a curved switch actuator, which fits within a recess in the rear portion of the sole. In this manner, the actuator, as well as the front curved lens provide a stylized, pleasing appearance for the footwear, without any obvious unsightly appendages.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 3 is a front elevational view of the footwear of FIG. 1;

FIG. 4 is a back elevational view of the footwear of FIG. 1.

FIG. 5 is an exploded pictorial view of the tip and heel sections of the central sole layer of the footwear of FIG. 1;

FIG. 6 is an elevational longitudinal cross-sectional view of the footwear of FIG. 1;

FIG. 7 is a pictorial exploded view of a light source and switch assembly of the footwear of FIG. 1;

FIG. 8 is a bottom plan view of the bulb-holding receptacle or assembly of the light source of FIG. 7;

BEST MODE FOR CARRYING OUT THE INVENTION

Figure 1:
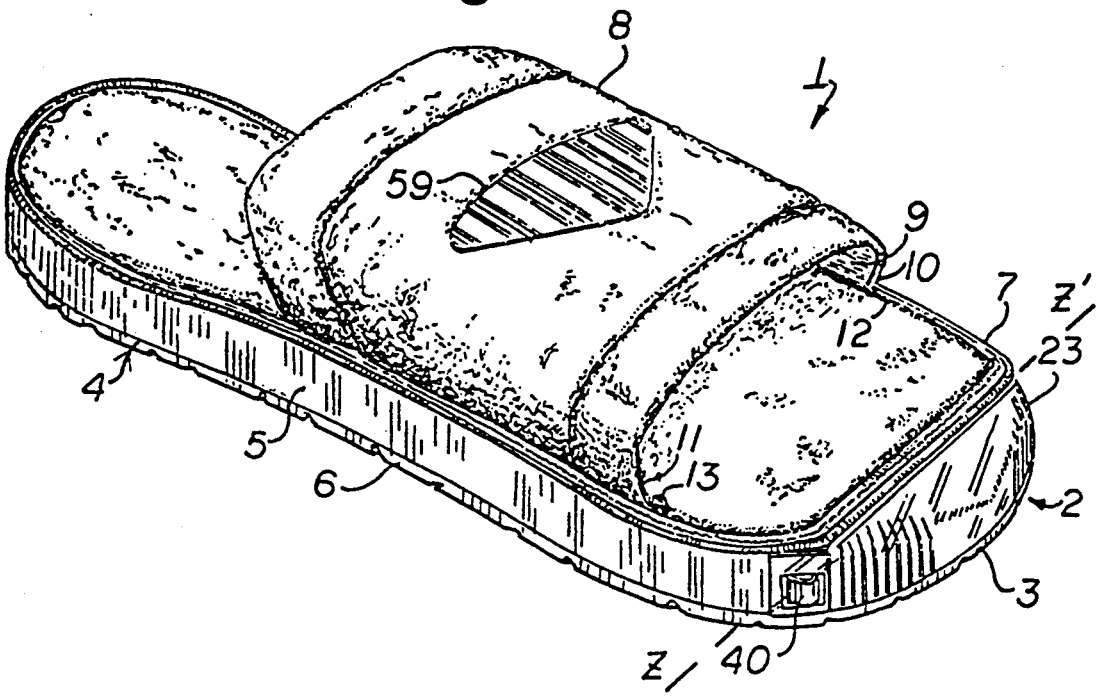
FIG. 1 is a front, top and right side pictorial view of an electrically lighted footwear which is constructed in accordance to the present invention.
Figure 2:
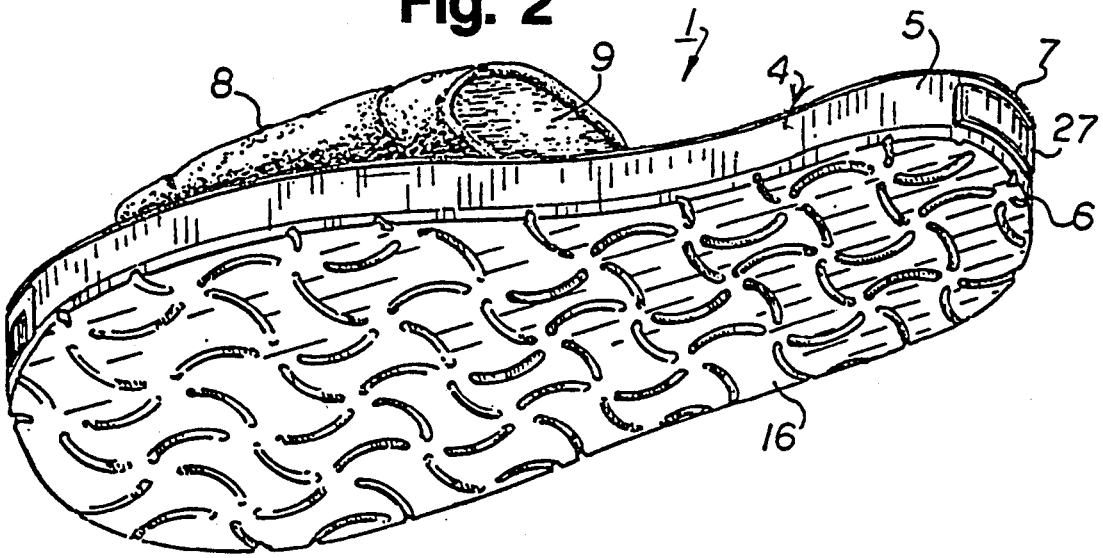
FIG. 2 is a back, bottom and left side pictorial view of the footwear of FIG. 1.

Referring now to the drawings, and more particularly to FIGS. 1 through 4, there is illustrated an electrically lighted footwear in the form of a slipper 1 which has a light source 2 built into the forward tip 3 of the sole 4. The sole 4 has a total thickness of at least two centimeters and includes a central layer 5 of EVA foam interposed between a lower layer 6 of similar material and an upper layer 7 of cork or cardboard covered with terry cloth.

A strap 8 made of terry cloth forms a loop 9 to engage the foot of the wearer. The lateral ends of the straps 10, 11 pass through slots 12, 13 cut through the upper layer 7, and are bonded, together with the upper layer, on the top surface 14 of the central layer 5. The lower layer 6 is similarly bonded to the bottom surface 15 of the central layer and has its own undersurface 16 sculptured for better friction on slippery floor surfaces.

As best illustrated in FIG. 5, the central layer 5, which is approximately three times as thick as the upper layer 7 or layer 6, and has a first cavity 17 into the tip portion for housing the light source 2. A second cavity 18 in the heel portion houses a toggling switch 19 used to activate the light source.

The first cavity 17 includes a quadrangular rear section 20 receives a battery housing 21, as illustrated in FIG. 6. The front tip 25 of the central sole is cut away along a transverse line X–X' in order to provide space for the light bulb or lamp mounting assembly 22 and a curved, wide angle lens 23. The lens 23 has the same radius of curvature as the front face 25*a* of the cut-away tip section 25 so that the lens 23 fits within the outer contours of the tip portion of the slipper in a stylized manner, to provide a pleasing appearance. The heel cavity section 18 forms a generally trapezoidal recess 24 to receive the toggling switch 19. A small cut-off heel section 26 along transverse line Y–Y' provides a recess for mounting a curved push-bottom 27 which activates the switch 19. It should be noted that the push-bottom 27 has a shape closely approximating the shape of the heel portion 26 cut-away from the central sole 5 to fit within the rear contour of the slipper to provide a stylized appearance. The pressable contact surface 28 of the push-button 27 has the same radius of curvature as the backface 26*a* of the cut-away heel section 26. When the push-bottom 27 is in place, its contact surface 28 lies flush with the heel back surface and appears as an extension thereof. Similarly, the arcuate shape of the lens 23 is designed to replace the missing tip portion 25 of the central layer 5, thus harmoniously blending within the sole periphery. The lens 23 and the push-bottom 27 form covers for the light source front cavity 17 and the switch back cavity 18 which are created when the top and bottom layers are glued to the central layer of the sole.

As detailed in FIGS. 7 and 8, the battery housing 21 can hold two side-by-side AA size batteries 29, 30. Two spring terminals 31, 32 mounted through the back wall 33 of the battery housing 21 provide contacts with the positive pole of one of the batteries and the negative pole of the other. A pair of conductors 34, 35 connects terminals 31, 32 to the terminals of the switch 19. The conductors run between the sole upper and central 5 layer.

Projecting from opposite sides of the battery housing frontal opening 36 are a pair of resilient prongs or spring fingers 37, 38. Each resilient prong has its distal end formed into a substantially quadrangular detent nib 39, 40. A pair of ears 41, 42 projecting from the side of the lens 23 have square holes 43, 44 which are shaped and positioned to capture the nibs 39, 40 associated with the battery housing 21. Thus, the lens 23 can be snapped into position by engaging the nibs 39, 40 through the holes 43, 44.

In order to remove the lens 23, the user pushes with thumb and index finger against the part of the nibs protruding through the holes to flex slightly the prongs 37, 38 until the lens 23 is free. The front of the lens describes a horizontal arc following the outline of the tip of the lower sole layer 6. It is also arched vertically and inwardly to meet the front edge of the top sole layer 7 along a straight line Z–Z' in the same vertical plane as the cutting line X–X'.

Interposed between the lens 23 and the battery housing 21 is the bulb-mounting assembly 22. This assembly includes a panel 45 whose outline matches the inner contour 46 of the lens, the panel 45 has a central cut-out 47 for passing the bulb 48 therethrough, and provides access to a quadrangular box 49 acting as a socket for the bulb 48. A first terminal strip 50 has a hole 51 through which the bulb 48 can be screwed. The bulb 48 is of the Krypton type with internal reflector to provide high intensity illumination. The front part of the bulb is angled upwardly by about 15 degrees for better illumination. A second flexible terminal strip 52 comes in contact with the rear central terminal 53 of the bulb.

Each terminal strip 50, 52 exits the box 49 through a pair of slots 54, 55 and terminates into opposite arcuate and resilient contact surfaces 56, 57 intended to come into electrical contact with the positive pole of one battery and the negative pole of another when the box is inserted into the battery housing 21. The bulb-mounting assembly 22 is not secured in any way to the battery housing, but is simply held in place by the lens 23 when the lens 23 is retrained by the detent nibs 39, 40. More specifically, the top and lateral edges of the panel 45 are clamped between the rim of the battery compartment opening 36 and the inner contour 46 of the lens 23 and the lens ribs 61, 63. Accordingly, the removal of the lens 23 provides access to all the light source components and for the replacement of the batteries or the bulb.

The slipper is assembled by first gluing or providing a suitable adhesive for the lower layer 6 to the undersurface 15 of the central layer 5, and then inserting the battery housing 21 and the switch 19 joined together by the conductors 34, 35 into their respective recesses 20, 24. Next, the top layer of the sole 7 and the strip 8 are bonded to the upper surface 14 of the central layer 7 of the sole. The push-button 27 is then mounted on the shaft 58 of the switch 19. The batteries 29, 30, bulb assembly 22, and lens 23 are sequentially put into place. Assembly is completed by engaging the lens 23 with the detent nibs 39, 40.

A reflective patch 59 stitched on the upper surface of the strap 8 helps to locate the slipper in a dimly lit room.

Figure 9:
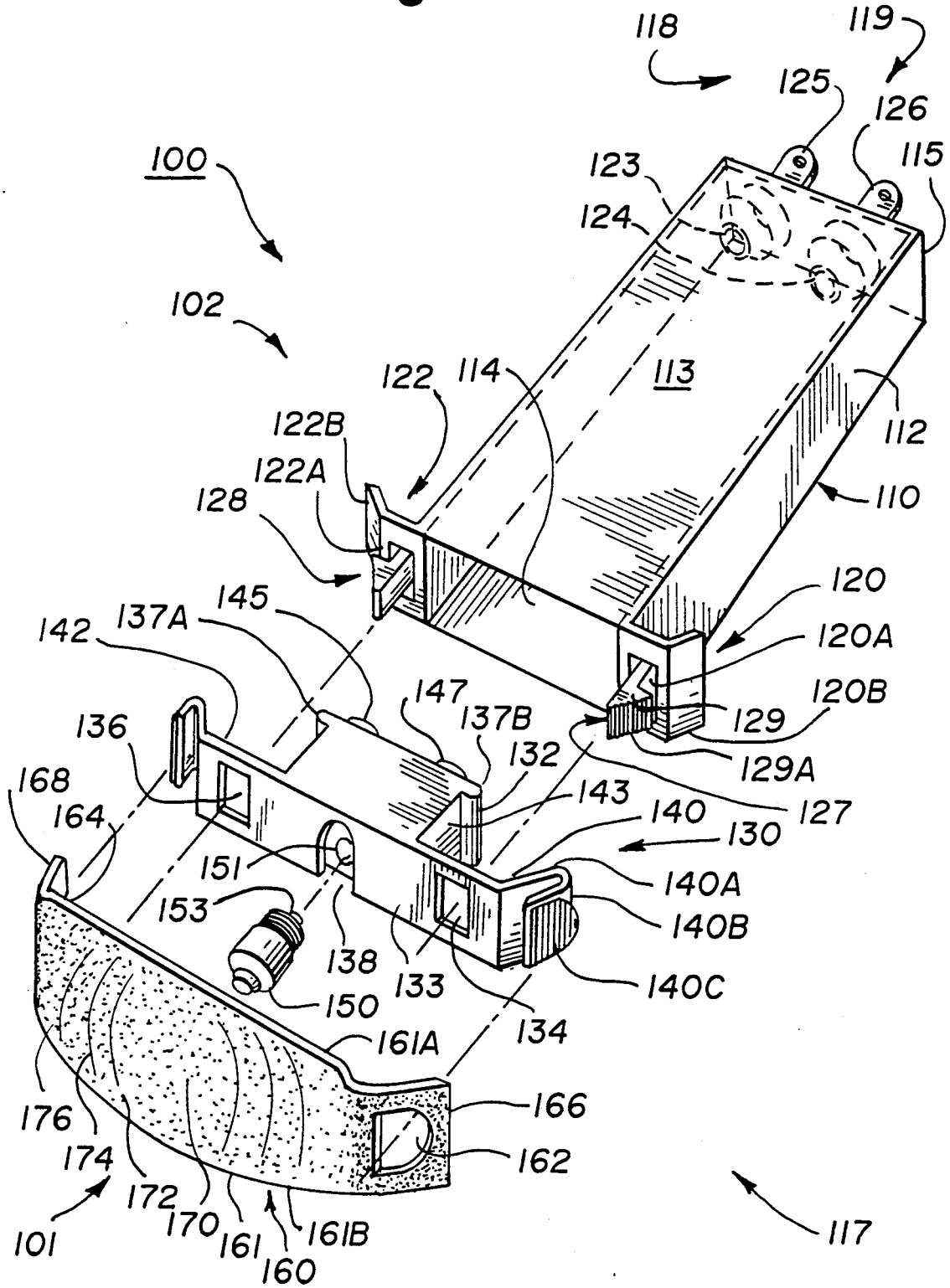
FIG. 9 is another electrically lighted footwear which is constructed in accordance to the present invention, and illustrating in a pictorial exploded view a light source assembly forming a part thereof.

Referring now to the drawings and more particularly to FIG. 9 thereof there is illustrated an electrically lighted footwear 100 which is constructed in accordance to the present invention. The footwear 100 is substantially similar to footwear 1 except as otherwise described herein.

As best seen in FIG. 9, the footwear 100 generally comprises a slipper 101 having a light source assembly 102 disposed within a pair of two spaced-apart cavities, a sole tip portion cavity 117 and a heel portion cavity 118. The heel portion cavity 118 is adapted to receive a toggle switch 119 used to activate the light source 102. The cavities 117 and 118 and toggle switch 119 are substantially similar to cavities 17 and 18 and toggle switch 19 respectively.

Figure 10:
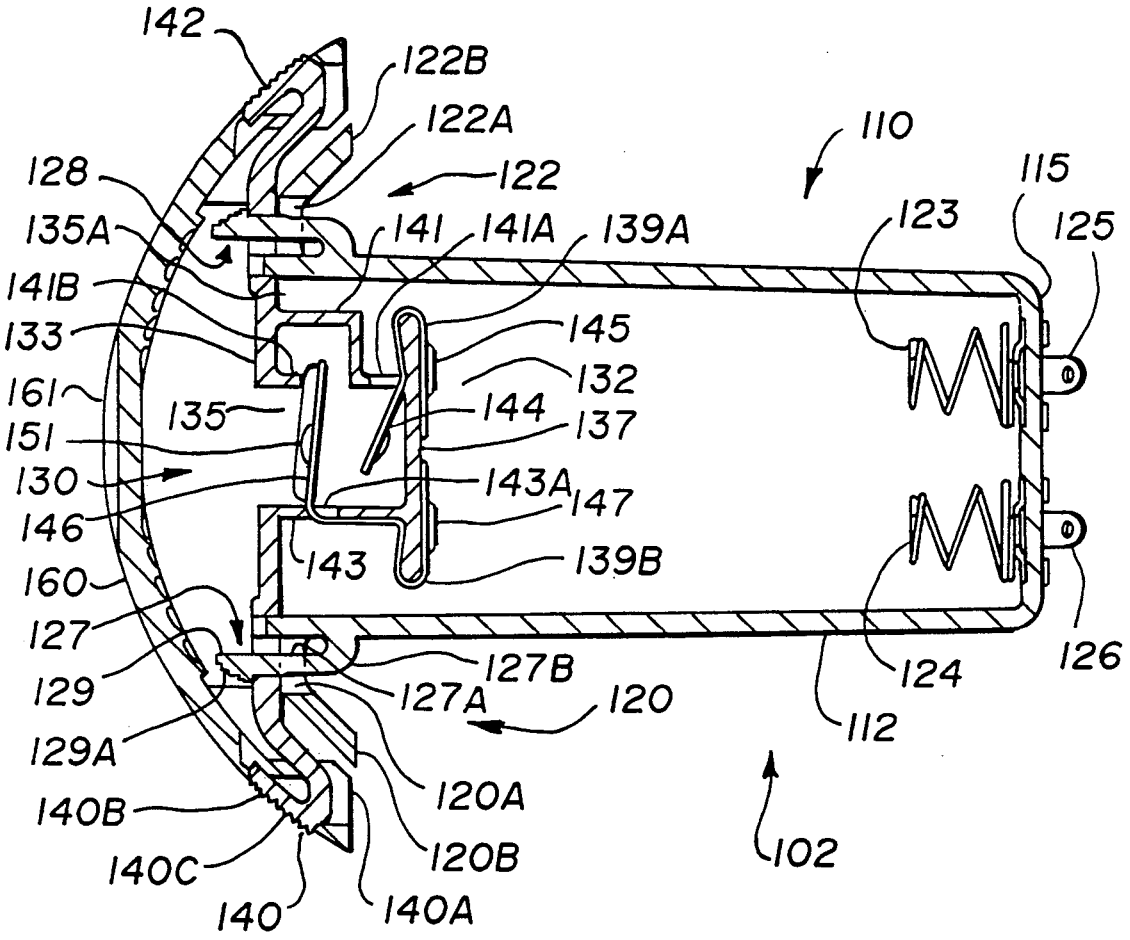
FIG. 10 is a plan section view of the light source assembly of FIG. 9.
Figure 11:
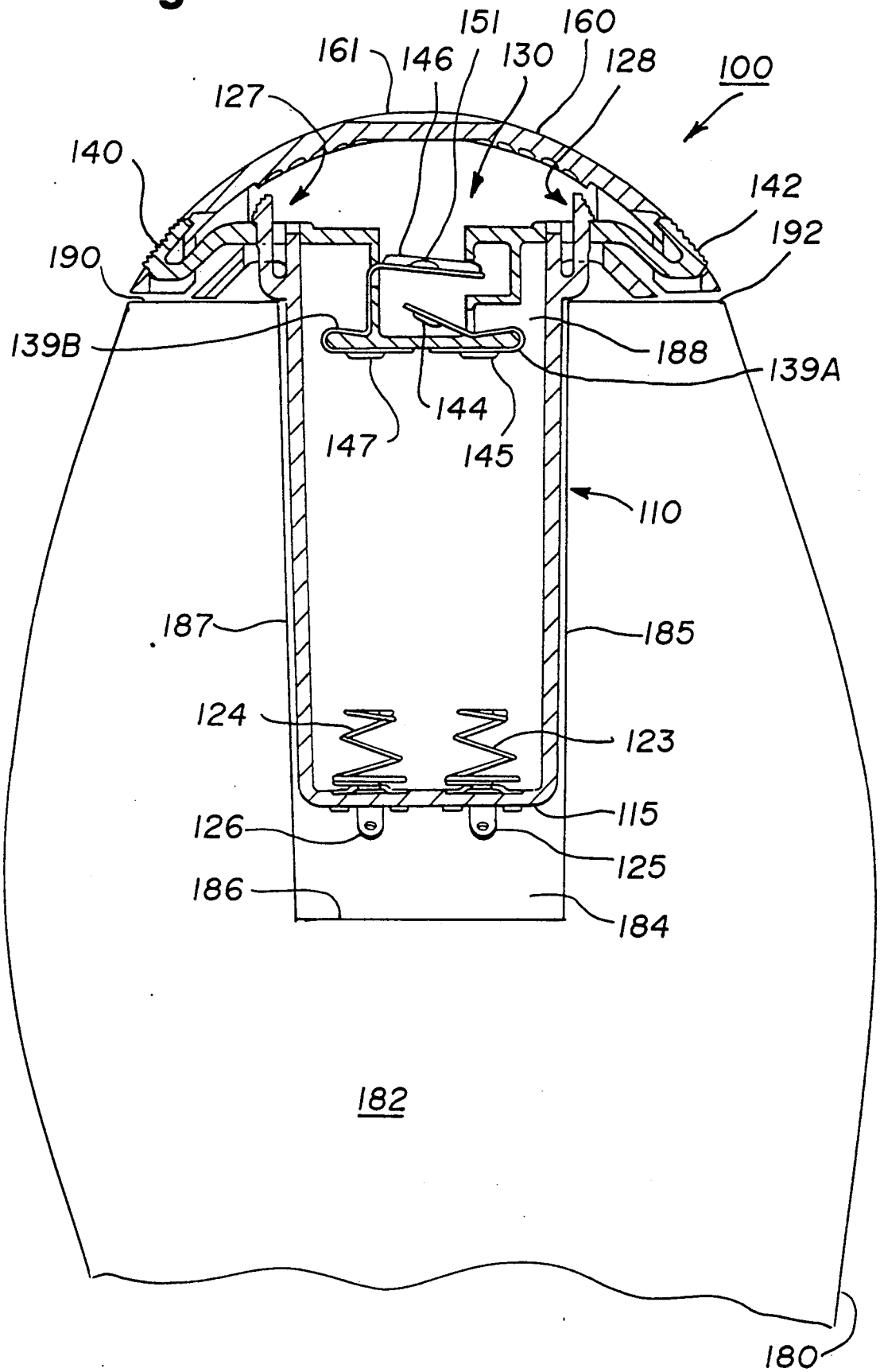
FIG. 11 is a bottom plan section view of a tip section of the central sole layer of the footwear of FIG. 9.

Considering now the light source assembly 102 in greater detail with reference to FIGS. 9–11, the light source assembly 102 generally includes a battery housing 110 for receiving a set of batteries (not shown), and a bulb-mounting assembly 130 adapted to be mounted removably to the battery housing 110 for securing the batteries within the battery housing 110 and for receiving and supporting removably a lamp or bulb 150. The light source assembly 102 also includes a lamp protective lens cover 160 adapted to be mounted removably to the lamp housing 130 for protecting the bulb 150 secured within the assembly 130.

In operation, in order to use the footwear 100 for lighting the path of travel of a user, the user must first install the bulb 150 within the bulb mounting assembly 130 and the batteries within the battery housing 110. In this regard, the user first removes the protective lens cover 160 from the bulb mounting assembly 130. In the above-mentioned disassembled position, the batteries are secured positively within the battery housing 110 by the bulb mounting assembly 130 and yet the user is able to quickly and easily install or replace the bulb 150 in the bulb mounting assembly 130.

If batteries need to be installed or replaced, the user next removes the bulb mounting assembly 130 from the battery housing assembly 110. When the bulb mounting assembly 130 is removed, the user may replace or install batteries within the battery housing 110 in a relatively easy and quick manner.

After the batteries have been installed within the battery housing 110, the user reverses the above described procedure. In this regard, the user attaches the bulb mounting assembly 130 with the bulb 150 installed therein, to the battery housing 110 thus, securing the batteries within the housing 110. The user then attaches the protective lens cover 160 to the bulb mounting assembly 130 to protect the bulb 150. The bulb 150 is then turned on by the user activating the toggle switch 119.

Considering now the battery housing 110 in greater detail with reference to FIGS. 9–11, the battery housing 110 generally includes a battery compartment 112 having a space 113 therewithin for receiving the batteries. The battery compartment 112 includes a frontal opening 114 to provide an access path into the battery receiving space 113 and a rear wall portion 115 to confine the batteries within the space 113. In this regard, the rear wall portion 115 cooperates with the side walls of the compartment 112 to retain or hold the batteries within the space 113.

The battery housing assembly 110 also includes a pair of compression springs or coils 123 and 124 which are mounted within the interior of the battery compartment 112 on the rear wall portion 115, for engaging the poles of the battery cells when the cells are installed within the compartment 112. A pair of electrical contacts 125 and 126 are attached to the outside of the rear wall portion 115 of the battery holder 112, and extend therethrough to provide an electrical path to the coils 123 and 124, respectively.

In order to enable the bulb mounting assembly 130 to be properly aligned with and mounted to the battery housing 110, the battery housing assembly 110 also includes a pair of alignment arms 120 and 122 each having passageway apertures 120A and 122A respectively. The alignment arms 120 and 122 extend outwardly from the battery compartment 112, in diametrically opposite directions, on opposite sides of the frontal opening 114. A pair of bent leg portions 120B and 122B extend rearwardly from alignment arms 120 and 122 respectively. The bent leg portions 120B and 122B extend rearwardly at a slight acute angle. The overall shape of each alignment arm, such as alignment arm 120, is complementarily shaped to corresponding portions of the bulb mounting assembly 130 as will be explained hereinafter in greater detail. Such complementarily shaped portions help facilitate the proper alignment of the bulb mounting assembly 130 with the battery housing assembly 110.

As best seen in FIGS. 10 and 11, a pair of resilient detent nibs 127 and 128 project forwardly from the battery compartment 112 on opposite sides of the frontal opening 114 through apertures 120A and 122A respectively. Each of the detent nibs 127 and 128 are substantially similar so only detent 127 will be described hereinafter in greater detail.

Considering now the detent nib 127 in greater detail with reference to FIGS. 9–11, the detent nib 127 includes a wedge shaped distal end portion 129 having a finger engageable face portion 129A. The detent nib 127 also includes a straight leg portion 127A projecting rearwardly from the end portion 120. The straight leg portion 127A terminates in an integrally connected curve portion 127B which projects outwardly from an outside portion of a sidewall of the battery compartment 112. The curved leg portion 127B is integrally connected to the battery compartment 112 and causes the straight leg portion 127A to be spaced apart from the compartment 112.

From the foregoing, it should be understood that when the finger of the us®r engages the face portion 129A and exerts an inwardly directed force, the straight leg portion 127A moves inwardly to a stressed position in substantial parallel alignment with the sidewall of the compartment 112. When the user releases the applied force, the straight leg 129A returns to its unstressed position as best seen in FIGS. 10 and 11.

Considering now the bulb mounting assembly 130 in greater detail with reference to FIGS. 9–11, the bulb mounting assembly 130 includes a bulb receiving compartment 132 having an open front wall portion 133 for providing the bulb 150 with an entranceway into an inner compartment space 135, and a closed rearwall portion 137 for providing a supporting surface for a pair of two irregularly shaped electrical contacts 139A and 139B respectively that will be described hereinafter in greater detail. Projecting outwardly from opposite sides of the rear wall portion 137 are a pair of flanges 137A and 137B for securing electrical contacts 139A and 139B, respectively. The flanges 137A and 137B being wider at their distal ends than where they join the rear wall portion 137.

The bulb receiving compartment 132 also includes a right side wall portion 141 and a left sidewall portion 143 for integrally connecting together the front and rearwall portions 133 and 137 respectively. The sidewall portions 141 and 143 include apertures 141A and 143A respectively to provide inner compartment space 135 accessway for the electrical contacts 139A and 139B respectively. Sidewall portion 141 is irregularly shaped to form interior subcompartment 135, as best seen in FIG. 10.

As best seen in FIG. 9, the front wall portion 133 includes a centrally disposed cut-out portion 138 for providing the bulb 150 access to the inner space of the bulb receiving compartment 132.

In order to enable the battery housing 110 to be secured removably to the bulb mounting assembly 130, the bulb-mounting assembly 130 includes a pair of detent members 140 and 142 respectively. The detent members 140 and 142 are integrally connected to the front wall portion 133 and extend outwardly therefrom in the same plane as wall 133 but in diametrically opposite directions. The detent members 140 and 142 include a pair of apertures 134 and 136 respectively. The apertures 134 and 136 are equally spaced apart form the cutout portion 138 and are spaced a sufficient distance from the cutout portion 138 to enable the detent nibs 127 and 128 respectively to pass therethrough. Each of the detent members 140 and 142 are substantially similar, so only detent member 140 will be described hereinafter in greater detail.

Considering now detent member 140 in greater detail with reference to FIGS. 9–11, the detent member 140 includes a rearwardly extending resilient arm 140A. Arm 140A extends rearwardly at an acute angle, such that when the bulb mounting assembly 130 is joined to the battery housing 110, arm 140A is substantially parallel to bent leg portion 120B. Detent nib 140B is attached to the distal end of arm 140A, projecting outwardly therefrom, and back in a forward direction, forming a gap between arm 140A and detent nib 140B. Detent nib 140B includes an outward facing finger engageable face portion 140C, which is "D" shaped and sized to removably engage lens 160, as will be described hereinafter in greater detail.

It should be understood that when the finger of the user engages the face portion 140C and exerts an inwardly directed force, the detent nib 140B moves inwardly to a stressed position. When the user releases the applied force, the detent nib 140B returns to its previous unstressed position as best seen in FIGS. 10 and 11.

As best seen in FIG. 10, electrical contacts 139A and 139B are juxtapositioned to hold the bulb 150 securely within the inner compartment 135 at an upward angle of about 15 degrees. Electrical contact 139A includes a terminal strip 144, positioned at an acute angle from the rearwall portion 137, for flexibly contacting the rear central terminal 153 of bulb 150 within the inner compartment 135. Electrical contact 139A is crimped to duplicate the shape of flange 137A and is secured to said flange 137A as the narrowest portion of the crimped area of contact 139A, adjacent to where flange 137A joins rearwall portion 137, resists being expanded to pass beyond the relatively wider distal end of flange 137A.

Electrical contact 139B includes a terminal strip 146 having an opening 151 for receiving bulb 150. Terminal strip 146 is angled rearwardly from the vertical plane at about 8 degrees. In this regard, it should be understood that when the user inserts the bulb 150 into opening 151 by way of threading, the bulb 150 attains an angle of about 7 degrees from the horizontal plane due to the angled threads of the bulb 150 passing through the flat tilted plane of terminal strip 146. As the threads of bulb 150 contact terminal strip 146, the bulb 150 becomes angled due to the angle of the threading. The result of terminal strip 146 being disposed at about 8 degrees from the vertical plane and the threading of the bulb 150 passing through, causing an additional angle of about 7 degrees, so the front light emitting portion of the bulb 150 is angled upwardly by about 15 degrees.

Terminal strip 146 extends from interior compartment 135 and into interior universal sub-compartment 135, which is formed by sidewall portion 141, through an adjoining passageway. Sub-compartment 135 includes a partial wall 141B adjacent to the passageway to prevent terminal strip 146 from moving beyond a position normal to sidewall portion 143 as the bulb 150 is threaded through opening 151 in terminal strip 146 and contacts terminal strip 144.

Electrical contact 139B is crimped to correspond substantially to the same shape of flange of 137B. Contact 139B is secured to the flange 137B as the narrowest portion of the crimped area of contact 139B, adjacent to where flange 137b joins rearwall portion 137, resists being expanded to pass beyond the relatively wider distal end of the flange 137B.

Each terminal strip 144 and 146 exits the box 132 and terminates into contact surfaces 145 and 147, intended to come into electrical contact with the positive pole of one battery and the negative pole of another (not shown) when the box 132 is inserted into the battery housing 110 through the frontal opening 114. The bulb-mounting assembly 130 is secured to the battery housing 110 when the resilient detent nibs 127 and 129 lockingly engage the openings 134 and 136, respectively. Once the bulb-mounting assembly 130 is secured, the batteries (not shown) within the battery housing engage the contact surfaces 145 and 147 of the forward end and are secured in engagement with the contact coils 123 and 124 respectively at the rear most end of the compartment 112.

As best illustrated in FIGS. 9 and 10, the lens 160 includes a central portion 161 for protecting and covering the bulb 150, and a pair of ears 166 and 168 for enabling the lens 160 to be secured to the bulb mounting assembly 130. Ears 166 and 168 are integrally connected at opposite ends of the central portion 161 and project rearwardly therefrom in an arcuate manner for enabling the lens 160 to engage detent members 140 and 142. As each ear is substantially similar, only ear 166 will be described hereinafter in greater detail.

Considering now the central portion 161 in greater detail with reference to FIGS. 10 and 11, the central portion 161 is generally arcuate in shape for spacing the inner surface of the central portion 161 from the bulb 150 when the lens 160 is secured to the bulb mounting housing 130. In this regard, the central portion 161 is generally uniform in cross section and includes a top edge 161A and a bottom edge 161B. The top edge 161A and bottom edge 161B form a boundary line between the tip portion of the slipper 101 and the lens 160 to provide a smooth contour appearance to the front portion of the slipper 101. The top edge 161A and the bottom edge 161B, are both arcuate in the horizontal plane. The lens 160 is also arcuate in the vertical plane. In this regard, when the lens 160 is engaged with detent members 140 and 142, the lens 160 completely encloses the bulb mounting assembly 130 and the battery housing 110 within the slipper 101.

As best seen in FIG. 9, the central portion 161 has a central circular clear transparent area 170 for enabling light emitted from the bulb 150 to pass therethrough.

Considering now only the left side of the central portion 161, viewed from the front of the slipper 101, the right side of the central portion 161 being a mirror image of the left side, repeated arcuate ribs 172, 174 and 176 radiate outwardly from the center spot 170 The ribs 172, 174 and 176 are molded into the central portion 161 and focus the light emitted by the bulb 150. The texture of the lens 160 outside of the central clear spot 170 is of a blast type finish, or its equivalent, for diffusing light outside of spot 170 emanating from the bulb 150, producing a sharp central beam of light.

Ear 166 has a "D" shaped opening 162 which is sized and positioned to capture detent nib 140B associated with bulb mounting assembly 130. The lens 160 is secured to the bulb mounting assembly 130 when the nib 140B is engaged with the opening 162.

In order to remove the lens 160, the user applies an inwardly directed force to the face portion 140C slightly compressing the detent member 140 until the face portion 140C no longer contacts the opening 162, allowing easy removal of the lens 160.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An electrical slipper having a front tip portion with an opening which receives illumination means, comprising:

convex lens means for covering the opening, and protecting the illumination means;

means defining an aperture for enabling said convex lens means to be secured to the illumination means;

upwardly inclined bulb socket means for causing a light emitting bulb disposed within the illumination means to be inclined upwardly at a sufficient angle to illuminate a substantial area forward of the front tip portion of the slipper;

means for engaging releasably said means defining an aperture to secure said convex lens means to the illumination means;

battery compartment means for holding battery means within a confined space disposed within the slipper;

a pair of oppositely disposed receiving means for enabling the illumination means to be secured removably to the battery compartment means; and wedge shaped nib means for engaging releasably said pair of oppositely disposed receiving means to said battery compartment means, wherein said battery means are thereby secured within said confined space.

2. In combination with a footwear having a substantially flat sole defining a rounded frontal tip and a rounded heel, a light assembly comprising:

a battery receptacle having at least one coiled contact element mounted therein and a frontal opening;

a first pair of arms projecting laterally from opposite sides of said frontal opening, each one of said first arms having a first detent nib extending forwardly;

a bulb-mounting assembly having openings sized and dimensioned to engage said first detent nibs and a second pair of arms projecting laterally from opposite sides, each one of said second arms having an end defining an outwardly extending second detent nib;

a lens having a clear central portion with defined arcs radiating outwardly therefrom and a pair of lateral ears shaped and positioned for interlocking contact with said second pair of nibs; and said sole having a forwardly located cavity with narrowly tapering sides for housing said light assembly.

3. In combination with a footwear having a substantially flat sole defining a rounded frontal tip and a rounded heel, a light assembly comprising:

said sole having a first cavity forming an aperture into said tip and a second cavity defining an opening into said heel;

a flashlight housed into said first cavity and having a lens closing said aperture;

a switch assembly housed into said second cavity and having an actuator member closing said opening;

a pair of conductors connecting the switch assembly to the flashlight;

said switch assembly compress a toggling interrupter;

said actuator member comprises a push button shaped and dimensioned to close said opening; and said flashlight comprising a battery receptacle having a frontal opening, a removable panel closing said frontal opening, a pair of flexible arms for projecting laterally from opposite sides of said frontal opening, each one of said flexible arms having an end defining an outwardly extending locking nib, a bulb mounted on said front panel, and said lens having a pair of lateral ears shaped and positioned for interlocking contact with said nibs.

4. The combination of claim 3, wherein each of said laterals ears has a hole shaped and dimensioned for engagement with one of said locking nibs.

5. The combination of claim 3, wherein said sole comprises:

a thin bottom layer;

a central layer at least twice as thick as the bottom layer;

a thin top layer; and said central layer having front and back cut-outs defining said first and second cavities between said bottom and top layers.

6. The combination of claim 5, wherein a tip section of the central layer has been cut away along a transversal line.

7. The combination of claim 6, wherein said lens comprises an arcuate face having a common radius of curvature with said tip section.

8. The combination of claim 7, wherein a median section of the lens is arched vertically and inwardly and meets a front edge section of the top layer of the sole.

9. The combination of claim 6, wherein a heel section of the central layer has been cut away along a transversal line.

10. The combination of claim 9, wherein said push-button comprises an arcuate pressable surface having a common radius of curvature with said heel section.

11. The combination of claim 3, which further comprises a bulb-mounting assembly including a box;

a pair of metallic strips mounted across an inner section of the box;

wherein one of said strips has a hole shaped to engage a socket section of the bulb and to hold said bulb in contact with the other strip.

12. The combination of claim 11, wherein said box is shaped and dimensioned to engage into said battery receptacle through said frontal opening, and includes said front panel, said front panel being larger than said opening.

13. The combination of claim 12, wherein said front panel is clamped between said battery receptacle and a back section of the lens.

14. The combination of claim 3, wherein said push-button comprises an outer surface being disposed flush with the outer surface of the heel section to provide a smoothly contoured configuration with the heel section.

15. The combination of claim 14, wherein said footwear comprises a strap attached to an upper portion of the sole;

said strap being positioned and sized to engage the foot of a wearer; and a luminescent patch mounted on said strap.

* * * * *